US011161172B2

(12) United States Patent
Kusic

(10) Patent No.: US 11,161,172 B2
(45) Date of Patent: Nov. 2, 2021

(54) DIECASTING DIE SYSTEM

(71) Applicant: Ferrofacta GmbH, Allendorf (DE)

(72) Inventor: Igor Kusic, Allendorf (DE)

(73) Assignee: Ferrofacta GmbH, Allendorf (DE)

( * ) Notice: Subject to any disclaimer, the term of this patent is extended or adjusted under 35 U.S.C. 154(b) by 247 days.

(21) Appl. No.: 16/079,561

(22) PCT Filed: Dec. 19, 2016

(86) PCT No.: PCT/DE2016/100598
§ 371 (c)(1),
(2) Date: Aug. 24, 2018

(87) PCT Pub. No.: WO2017/148457
PCT Pub. Date: Sep. 8, 2017

(65) Prior Publication Data

US 2019/0054522 A1 Feb. 21, 2019

(30) Foreign Application Priority Data

Mar. 1, 2016 (DE) ..... 102016103618.8

(51) Int. Cl.
*B22D 17/22* (2006.01)
*B22D 17/20* (2006.01)
(Continued)

(52) U.S. Cl.
CPC ..... *B22D 17/2281* (2013.01); *B22D 17/02* (2013.01); *B22D 17/04* (2013.01);
(Continued)

(58) Field of Classification Search
CPC ..... B22D 17/02–06; B22D 17/2076; B22D 17/2092; B22D 17/2272; B22D 17/2281
See application file for complete search history.

(56) References Cited

U.S. PATENT DOCUMENTS 3,010,156 A * 11/1961 Smith ..... B29C 45/2806 425/146
2002/0189781 A1* 12/2002 Shibata ..... B22D 17/2038 164/113

(Continued)

FOREIGN PATENT DOCUMENTS

CN 103282144 A 3/2013
CN 104114302 A 1/2014

(Continued)

*Primary Examiner* — Kevin E Yoon
*Assistant Examiner* — Jacky Yuen
(74) *Attorney, Agent, or Firm* — Michael Solderman

(57) ABSTRACT

The invention relates to a diecasting method and a diecasting nozzle system (10) for use in a hot-chamber system (1) for the diecasting of metal melt (4), comprising a hot-chamber diecasting machine (2) with a casting vessel (3) and a melt distributor (20), which distributes the melt (4) from a machine nozzle (7) among uniformly heated diecasting nozzles (40). Arranged between a sprue region (42) of the diecasting nozzles (40) and the casting vessel (3) is at least one nonreturn valve (48), which prevents the melt (4) from flowing back from the sprue region (42) in the direction of the casting vessel (3). According to the invention, the nonreturn valve (48) is respectively arranged between the sprue region (42) of at least the upper diecasting nozzles (40) and a final branch of melt runners (22) in the melt distributor (20) to each of the diecasting nozzles (40).

12 Claims, 4 Drawing Sheets

(51) Int. Cl.
*B22D 17/04* (2006.01)
*B22D 17/02* (2006.01)

(52) U.S. Cl.
CPC ..... *B22D 17/2023* (2013.01); *B22D 17/2038* (2013.01); *B22D 17/2272* (2013.01)

(56) References Cited

U.S. PATENT DOCUMENTS

| | | | |
|---|---|---|---|
| 2003/0209532 | A1 | 11/2003 | Schmidt |
| 2007/0181281 | A1 | 8/2007 | Manda |
| 2007/0221352 | A1 | 9/2007 | Manda |
| 2013/0233507 | A1 | 9/2013 | Müller |
| 2014/0319188 | A1 | 10/2014 | Kusic |

FOREIGN PATENT DOCUMENTS

| | | | | | |
|---|---|---|---|---|---|
| DE | 19807568 | A1 | | 8/1998 | |
| DE | 10354456 | A1 | | 6/2004 | |
| DE | 10359692 | A1 | | 7/2004 | |
| JP | 06126412 | A | * | 5/1994 | ..... B29C 45/2806 |
| JP | 06210672 | A | * | 8/1994 | ..... B29C 45/234 |
| KR | 1020130140778 | B1 | | 12/2013 | |

* cited by examiner

DIECASTING DIE SYSTEM

CROSS REFERENCE TO RELATED APPLICATIONS

This application is the U.S. national stage of International Application No. PCT/DE2016/100598, filed on 2016 Dec. 19. The international application claims the priority of DE 102016103618.8 filed on 2016 Mar. 1; all applications are incorporated by reference herein in their entirety.

BACKGROUND

The present invention relates to a diecasting method and a diecasting nozzle system for use in a hot-chamber system for the diecasting of metal melt, comprising a hot-chamber diecasting machine with a casting vessel and a melt distributor, which distributes the melt uniformly from a machine nozzle among uniformly heated diecasting nozzles. Arranged between a sprue region of the diecasting nozzles and the casting vessel is at least one nonreturn valve, wherein the nonreturn valve prevents the melt from flowing back from the sprue region in the direction of the casting vessel.

Sprue as a casting byproduct, which in conventional diecasting methods solidifies in the runners between the diecasting nozzle and the casting mold and connects the castings in an ultimately undesired manner after demolding, incurs additional material effort that generally accounts for 40% to 100% of the weight of the casting. Even if the sprue is remelted for material recycling, this involves energy and quality losses due to the creation of scum and oxide fractions. Sprueless diecasting avoids these drawbacks.

For sprueless diecasting, it is necessary to either pass the melt in the liquid state from the melting pot to the mold and back for each casting, which however also results in losses in quality or at least in time losses, or to provision the melt in the liquid state at the sprue of the mold. The latter is done in the hot-chamber approach, where all runners are heated up to the sprue such that the melt remains liquid and, favorably, is at the same time prevented from flowing back to the melting pot.

The backflow to the melting pot can be prevented through valves, but particularly advantageously also through a plug of solidified melt that closes the sprue opening in the diecasting nozzle.

While conventional valves do prevent backflow of the melt to the melting pot, in the case of multi-path systems they are ill-suited for preventing melt from flowing from upper-level paths into lower-level paths and from escaping from the diecasting nozzle. While this is prevented through closure using a plug of solidified melt, due to the required rapid alternations between melting and solidifying, it is complicated to achieve short work cycle times and thus high dynamics with this method.

SUMMARY

The invention relates to a diecasting method and a diecasting nozzle system (10) for use in a hot-chamber system (1) for the diecasting of metal melt (4), comprising a hot-chamber diecasting machine (2) with a casting vessel (3) and a melt distributor (20), which distributes the melt (4) from a machine nozzle (7) among uniformly heated diecasting nozzles (40). Arranged between a sprue region (42) of the diecasting nozzles (40) and the casting vessel (3) is at least one nonreturn valve (48), which prevents the melt (4) from flowing back from the sprue region (42) in the direction of the casting vessel (3). According to the invention, the nonreturn valve (48) is respectively arranged between the sprue region (42) of at least the upper diecasting nozzles (40) and a final branch of melt runners (22) in the melt distributor (20) to each of the diecasting nozzles (40).

DETAILED DESCRIPTION

This problem results in the object to provide a diecasting nozzle system for use in a diecasting hot-chamber system for metal melts which enables simple temperature control and a simple structure.

The object is solved by a diecasting nozzle system for use in a hot-chamber system for the diecasting of metal melt, comprising a hot-chamber diecasting machine with a casting vessel and a melt distributor, which distributes the melt uniformly from a machine nozzle among heated diecasting nozzles, wherein at least one nonreturn valve is arranged between a sprue region of the diecasting nozzles and the casting vessel, said nonreturn valve preventing the melt from flowing back from the sprue region in the direction of the casting vessel. For this, low-viscosity melts, in particular of non-ferrous metals, with a melting temperature up to that of aluminum are predominantly provided. In the prior art, however, the liquid melt may be retracted from an upper nozzle and at the same time flow out of a lower nozzle in an undesired manner due to gravity.

To solve this problem, according to the invention, the nonreturn valve is respectively arranged between the sprue region of at least the upper diecasting nozzle, or in the case of multiple nozzles, the upper diecasting nozzles and a final branch in the melt distributor to each of the diecasting nozzles. Through this, melt can be prevented from escaping from the diecasting nozzles at any time when no melt is injected via the melt distributor, which would lead to contamination and hazards in particular in the case of an open mold. The risk of melt escape results from the fact that the melt runners form pipes communicating in the melt distributor, so that melt from a diecasting nozzle arranged in the upper region of the melt distributor may flow back and accordingly melt may flow out of a diecasting nozzle arranged in the lower region of the melt distributor due to the effect of gravity. This is however prevented by the nonreturn valve in the region between the sprue region of the diecasting nozzle and the final branch in the melt distributor to at least said diecasting nozzle, for example in the upper diecasting nozzle itself.

According to an advantageous embodiment, the diecasting nozzles can be heated from inside and/or from outside in the region of a nozzle body and comprise sprue regions that have at least a thermal conductivity of the melt to be processed and/or can be heated separately. It is particularly advantageous if the heating is performed from outside and the heat is transferred into the sprue regions, so that an internal heater can be dispensed with. Provision is thus made for the diecasting nozzle to be heated from outside, wherein the external heater may also be configured as a printed heater (thick film heater). The external heater may be formed through a brass or high-grade steel sleeve that can be shrink-fitted and contains the heater.

Due to the low heat dissipation from the sprue region, the diecasting nozzle can thus be heated indirectly by the heat transferred from the heated nozzle body into the sprue region. A heat conductivity as high as possible, and in any case not lower than that of the melt itself (e.g. Zn>100 W/mK, Mg about >60, Al about 235 W/mK), is made possible through appropriate material selection, for example a molybdenum alloy, tungsten or a heat conducting ceramic material. Alternatively or additionally, the diecasting nozzle is heated internally, which is also within the scope of the invention.

It is further advantageous to provide a thermal protective device in the sprue region of each diecasting nozzle, which reduces heat dissipation from the sprue region in the direction of the casting mold. A thermal insulator located in the sprue region is particularly suitable for this. A thermal insulator may be envisaged here that is configured as an insulation ferrule made of a material surrounding the sprue region and having a low heat conductivity, such as titanium alloys or ceramics, or as an insulating air, gas or vacuum layer inside the sprue region, and/or as a constant air layer between the body of the diecasting nozzle and the casting mold, which forms a uniform or circumferential air gap acting as an insulating space. The insulation serves to avoid heat losses and to minimize the heating power.

The sprue region of the mold preferably includes an insulator which reduces heat dissipation into the mold. The insulator forms part of the nozzle and, in contrast to plastic injection moulding techniques, is not formed by the mold or the melt. As an alternative or in addition to said heat insulation, provision is further made for the sprue region of the mold to be heated, which creates an "active insulation" so to speak, so as to further reduce the heat dissipation from the sprue region by these additional measures. Through this, the melt in the sprue region remains in the liquid state and does not need to be melted again after separation of the casting. This achieves a heating of the nozzle in a simple manner while providing all the advantages of provisioning the melt in the nozzle. To this end, provision is also made for the front part of the nozzle to be manufactured of an insulating material.

Alternatively, a further embodiment including a counter-heater is provided in order to reduce heat dissipation. Said counter-heater is preferably configured as a segment that is arranged around the sprue and can be temperature-controlled separately, and/or as a separately heatable sprue region. A counter-heater that uses a highly dynamic $CO_2$ cycle for its operation has proven to be particularly advantageous.

A high product quality is achieved by a melt runner which in the region of the sprue region of the diecasting nozzle includes a separation edge that is designed such that it forms a breaking point reducing a cross-section in the melt solidified in the sprue region, where the article will separate when the sprue region is lifted off the mold. The separation edge is arranged on one side either circumferentially on the outer side of a central duct or on the inner side of the melt duct, and in each case at the lower end located towards the sprue region. An arrangement on both sides may also be provided.

Further, it has shown to be beneficial to arrange a temperature sensor in the sprue region. Said temperature sensor generates measured values that can be used to control the nozzle heater. A controlled nozzle heater enables an optimized procedure, increases productivity and product quality, and reduces wear of the diecasting nozzle. The temperature sensor in the front region of the nozzle, which is the region near the sprue, thus assists in achieving an optimized operation of the heater in that its measured values are used to control the nozzle heater.

Arrangement of the nonreturn valve directly in the nozzle channel of the diecasting nozzle has shown to be particularly advantageous. A suitable nonreturn valve includes a freely moving ball, particularly in a cage, which cooperates with a valve seat.

It is favorable if the nozzle includes a defined sprue geometry. A ring, for example, provides for a clean separation, and further provided shapes may be cross or star shapes. The central duct forming the ring may have a longitudinal hole reaching through the sprue region. This achieves an improved flow of the melt with equally good separation. The quality of the separation is further improved by a separation edge that may be arranged inside and/or outside in the sprue region. The diecasting nozzle thus advantageously has a sprue geometry that is adapted to the respective requirements.

The sprue will cool down only if the heat flows into the casting, i.e. the product, and cools the sprue region as long as the casting remains connected to the sprue region. However, the sprue region does not cool down too far since, due to a thermal insulation in the sprue region of the nozzle, only a small amount of heat dissipates directly into the mold. This way, the heat flow is essentially canalized via the liquid or solidified melt.

A further aspect of the invention is a diecasting method that uses a diecasting nozzle system according to the above description. The diecasting method comprises the following method steps:

- fitting the permanently and uniformly heated diecasting nozzle onto the casting mold;
- opening the nonreturn valve during injection of the melt through the melt runner and the sprue region into the casting mold;
- solidifying the melt to obtain a product inside the casting mold including the sprue region, wherein heat flows from the sprue region into the product;
- lifting off the diecasting nozzle, separating the product, and non-occurrence of heat dissipation from the sprue region;
- melting the solidified melt in the sprue region of each of the diecasting nozzles through continued heat flow from the nozzle body, wherein melt flowing from the upper nozzles via the distributor is prevented from flowing out of the lower nozzles in the distributor by closing the nonreturn valves in the region of the upper nozzles.

Such a method does not require formation of a sealing melt plug in the sprue region, so that the diecasting work cycle frequency can be increased and the alternating thermal stress on the diecasting nozzle can be reduced. Also, melt can be prevented more reliably from escaping.

BRIEF DESCRIPTION OF THE DRAWINGS

Further details, features and advantages of the invention become apparent from the following description of embodiment examples with reference to the associated drawings. In the drawings.

DETAILED DESCRIPTION OF THE PREFERRED EMBODIMENTS

Figure 1:
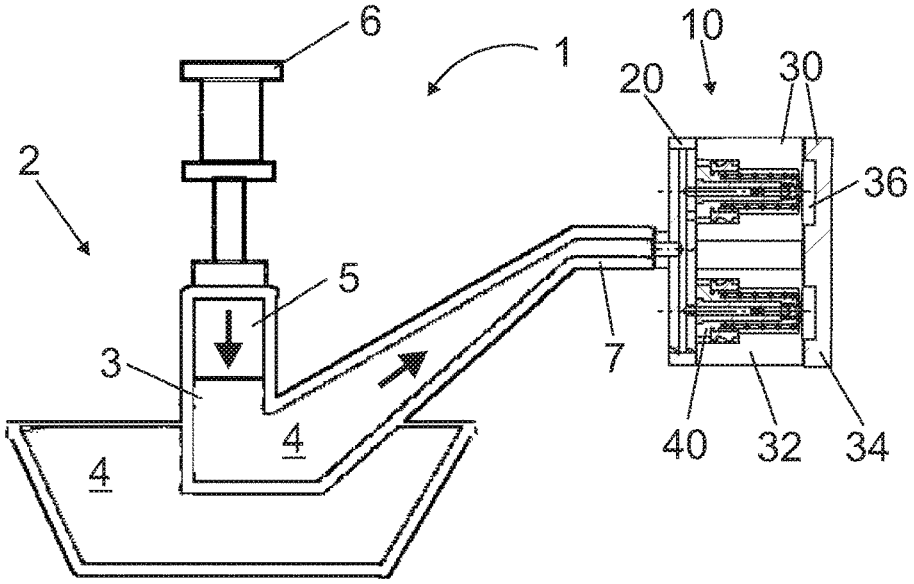
FIG. 1 is a schematic illustration of a diecasting nozzle system according to the invention.

FIG. 1 schematically illustrates a hot-chamber system 1 comprising an embodiment of a diecasting nozzle system 10 according to the invention connected to a conventionally known hot-chamber diecasting machine 2. The hot-chamber diecasting machine 2 comprises a casting vessel 3, which contains melt 4. The latter is forced downward by a piston 5, which is driven by a piston drive 6, so that the melt 4 reaches the diecasting nozzle system 10 via a machine nozzle 7.

In the diecasting nozzle system 10, the melt 4 is first forced into the melt distributor 20, which distributes the melt 4 among the individual diecasting nozzles 40. The diecasting nozzles 40 are directly connected to the static mold half 32 as a part of the casting mold 30. Located between the static mold half 32 and a moving mold half 34 is a cavity 36 in which the product is formed upon injection and solidification of the melt 4.

Figure 2:
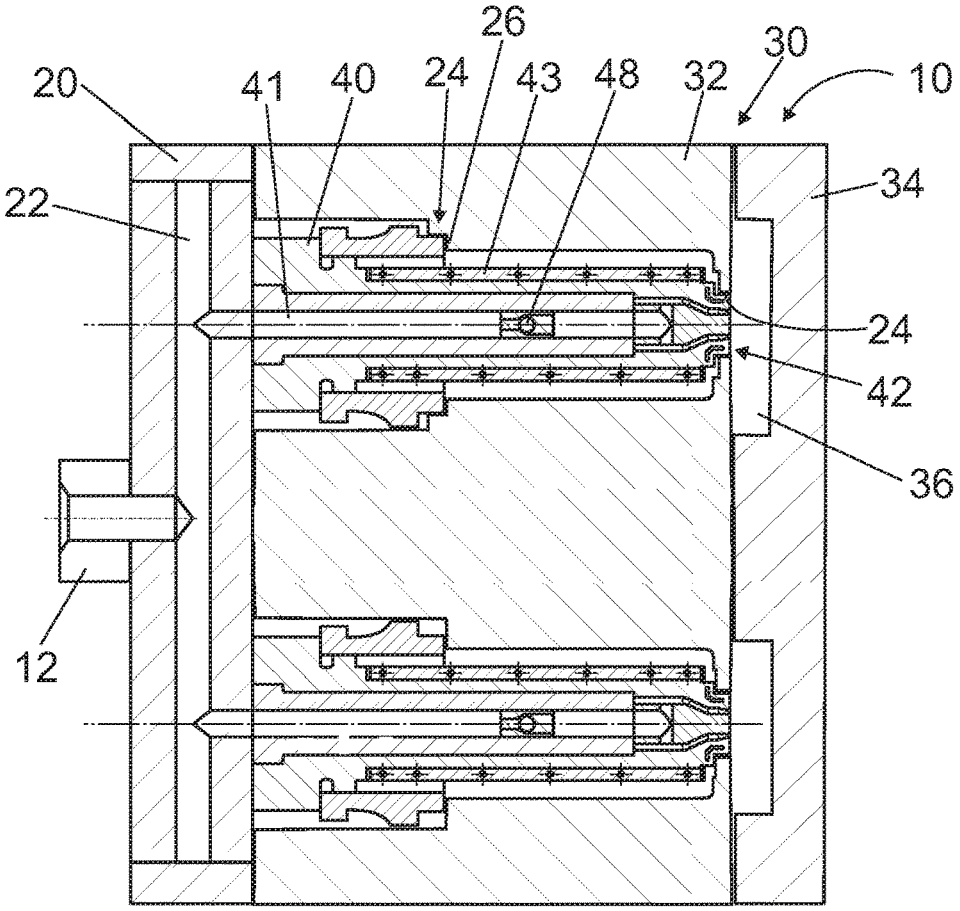
FIG. 2 is a schematic cross-sectional illustration of a diecasting nozzle system according to the invention with two diecasting nozzles.

FIG. 2 is a schematic cross-sectional illustration of an embodiment of a diecasting nozzle system 10 according to the invention with two diecasting nozzles 40, an upper one and a lower one. The diecasting nozzles 40 are inserted into the static mold half 32 of the casting mold 30 and are connected to the melt distributor 20. Two radial seats 24 and an axial seat 26, at which the diecasting nozzle 40 is supported, secure it in its position inside the casting mold 30. The sealing function of the front radial seat 24 may further also be improved by an additional sealing member, which is not depicted here. The function of this gap will be described in more detail in connection with FIG. 3.

When the diecasting nozzle system 10 is in operation, the machine nozzle is positioned at a machine nozzle boss 12, via which it is fitted, and thus tightly connected, to the melt distributor 20 under mechanical pressure. Through this, the melt can flow from the casting vessel into a melt runner 22 of the melt distributor 20 and to the diecasting nozzles 40 and reach their respective nozzle channels 41. From the nozzle channel 41, the melt flows through the nonreturn valve 48, which opens in the flow direction, to the sprue region 42, where it is injected into the cavity 36. There, the product is formed upon solidification of the melt in the cavity. The melt may further also solidify in the sprue region 42 since the heat of the melt is dissipated via the casting mold 30 (which is oftentimes additionally cooled).

In a particularly advantageous embodiment, the nonreturn valve is configured as a ball valve such that the ball has a low weight and performs a short stroke, for example one millimeter. This property enables the diecasting nozzle to perform its function according to the invention in a highly dynamic manner.

For removal of the finished product, the moving mold half 34 is lifted off. In this process, the product is separated from the sprue region 42 of the diecasting nozzle 40. The separation of the product and the removal of the moving mold half 34 at the same time eliminates the dissipation of heat into the casting mold 30. The heat generated by a nozzle heater 43 and transferred to the diecasting nozzle 40 thereupon heats the sprue region 42 far enough for the melt solidified in the sprue region 42 to remelt. The nozzle heater 43 is in this case configured as a sleeve, for example made of brass or high-grade steel, which contains the heater and is fitted onto the body of the diecasting nozzle 40.

As a result, the sprue region in the diecasting nozzles 40 is open for the ejection of the melt again. As long as only one diecasting nozzle 40 is present, the melt would be prevented from escaping by capillary forces or lack of pressure balance. However, as soon as multiple diecasting nozzles are present, in particular arranged in a stacked manner, air may enter the upper diecasting nozzle 40 through the sprue region 42. The entering air then causes a pressure balance in the melt runner 22 of the melt distributor 20, so that the melt may flow back from the upper diecasting nozzle 40 to the melt runner 22 and may escape from the lower diecasting nozzle 40 in an undesired manner, in particular in the case of an open casting mold 30. The same applies of course if the melt does not solidify in the sprue region but remains fluid.

To prevent the melt from flowing out, a nonreturn valve 48 is provided according to the invention which prevents the melt from flowing back to the melt runner 22 of the melt distributor 20. As a result, due to the lack of pressure balance, melt cannot escape from the lower diecasting nozzle 40. Through this, even the sprue region 42 of the respectively lower nozzles remains practically sealed even without additional measures for closure such as a solidified melt plug or a nozzle needle.

Figure 3:
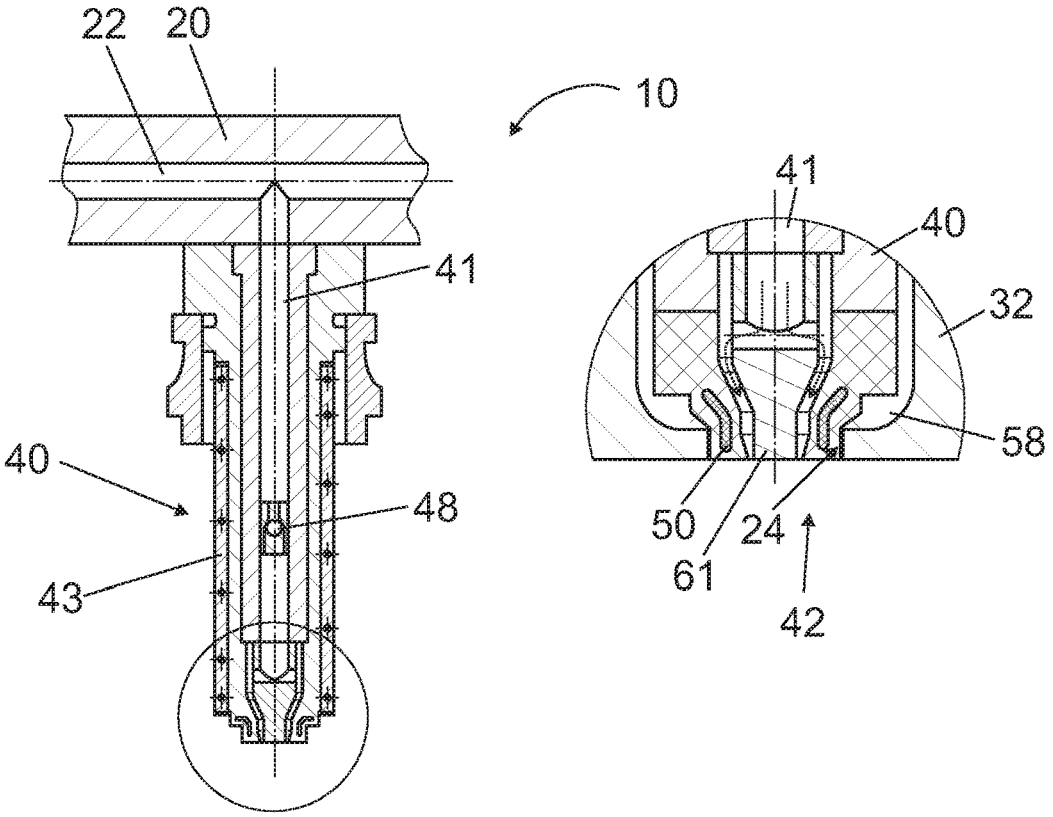
FIG. 3 shows a further embodiment of the diecasting nozzle.

FIG. 3 is a schematic cross-sectional illustration of an embodiment of the diecasting nozzle 40 of the diecasting nozzle system 10 according to the invention including a detail view of the sprue region 42. The diecasting nozzle 40 is coupled to the melt distributor 20, so that its melt runner 22 is in communication with the nozzle channel 41. Further, the nonreturn valve 48, which is schematically illustrated here, is advantageously arranged inside the nozzle channel 41. However, it might just as well be arranged at any position in the depicted section of the melt runner 22.

Further shown are the nozzle heater 43 and (only in the detail view) a part of the static mold half 32, against which rests the diecasting nozzle 40. To avoid heat dissipation from the diecasting nozzle 40 to the static mold half 32 via the resting support in the sprue region 42, i.e. the radial seat 24, a thermal insulator is provided. In the depicted example, said insulator consists in an air space 58, which surrounds a substantial part of the diecasting nozzle 40, and in particular in a sprue insulator 50. The sprue insulator 50 is arranged directly in the sprue region 42. It consists of a hollow space into which air, some other gas or an insulating material has been introduced. Moreover, provision is made for the sprue region to be fabricated of a different material having a reduced heat conductivity, for example a ceramic material. The sprue insulator 50 may be formed by joining parts configured to define the hollow space via a form lock or an adhesive connection.

The sprue insulator 50 particularly effectively prevents a large portion of the heat from being dissipated via the radial seat 24. This enables heating of the sprue region 42 and melting of melt solidified there via the existing nozzle heater 43 without requiring arrangement of an additional heater in the sprue region 42. However, such an alternative solution, in which a separate nozzle heater is provided for the sprue region, is also within the scope of the invention.

Figure 8:
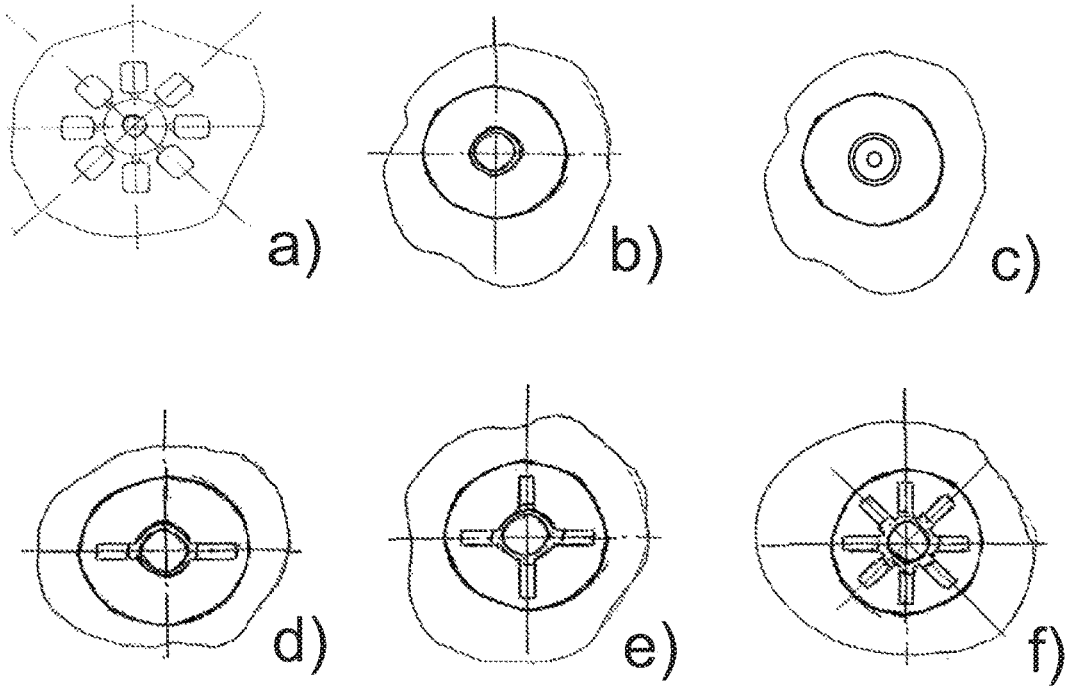

Dotted lines with arrows in the detail view further indicate the path of the melt flow in the final section of the nozzle channel 41 and to the sprue region 42. In the depicted embodiment example, the sprue region 42 has an annular sprue geometry. The latter is formed by the melt runner 41 near the sprue region 42 having a central duct 61 that passes the melt to the outside and into a cylindrical gap, which results in the annular sprue geometry. Further advantageous sprue geometries are shown in FIG. 8.

Figure 4:
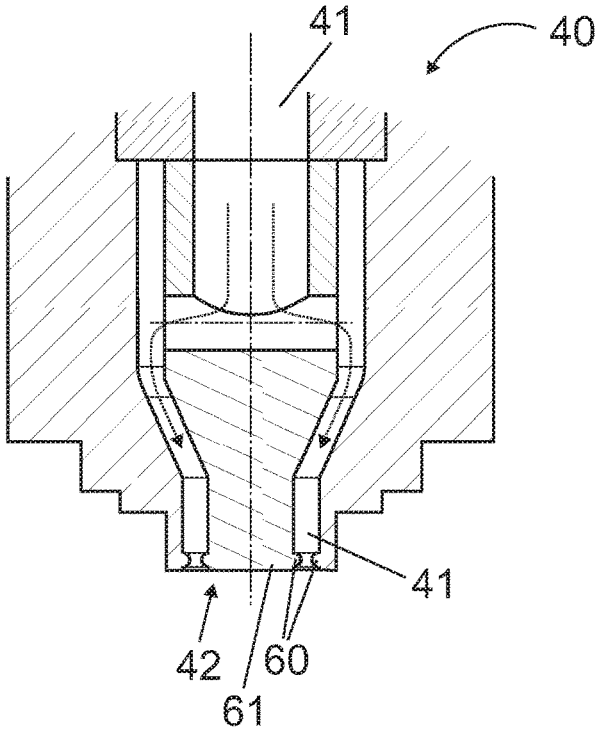
FIG. 4 shows an embodiment of a detail of the diecasting nozzle according to the invention in the sprue region.

FIG. 4 is a schematic cross-sectional illustration of an embodiment of a detail of the diecasting nozzle 40 according to the invention in the sprue region 42. As in FIG. 3, the melt flow in the nozzle channel 41 is indicated here as well.

An important feature of the diecasting nozzle 40 according to the invention is shown in the sprue region 42. The latter comprises a separation edge 60, which may be provided on one side or on both sides, i.e. on the inner side at the central duct 61 and/or on the outer side in the lower section of the melt duct 41 as a respective circumferential protrusion. Shown is a two-sided configuration in the inner and outer region, wherein the separation edge 60 creates a reduced cross-section between the product, which consists of the solidified melt, and the "frozen" sprue region, i.e. the melt plug formed in said region. Said reduced cross-section forms a breaking point at which the product separates from the melt plug in the sprue region in a defined manner and thus provides for the creation of a proper sprue on the product that does not require postprocessing.

Figure 5:
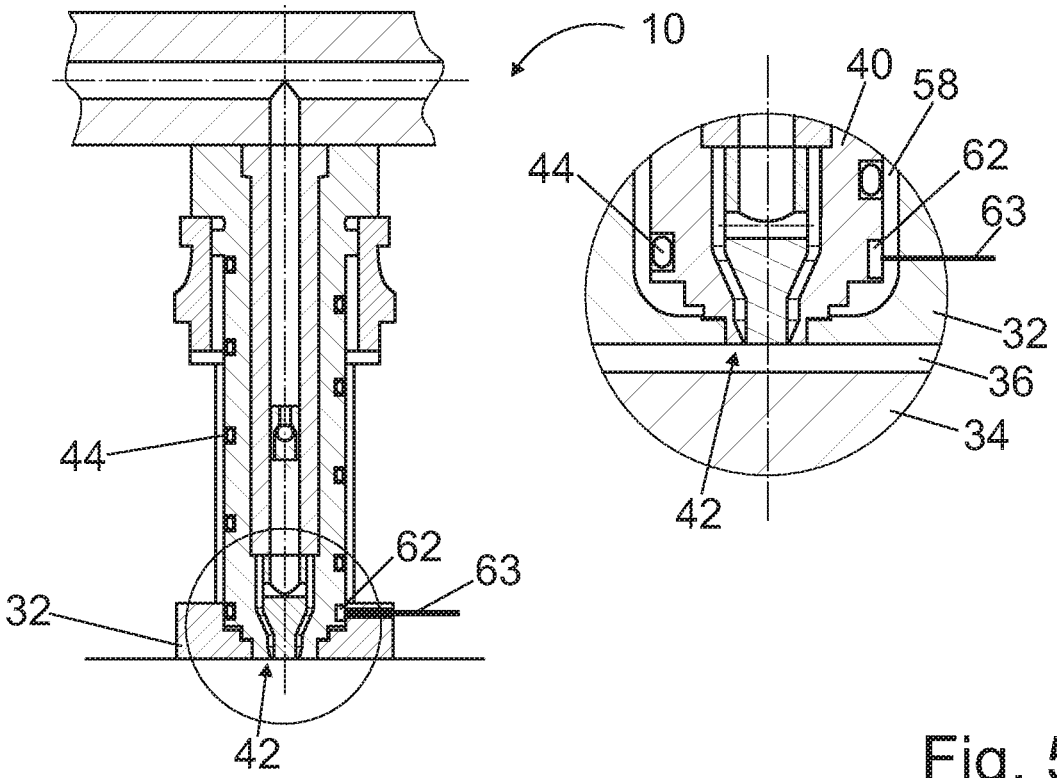
FIG. 5 shows a further embodiment of the diecasting nozzle system according to the invention.

FIG. 5 is a schematic illustration of an embodiment of the diecasting nozzle system 10 according to the invention including, similar to the illustration of FIG. 3, a detail view of the sprue region 42, which in addition to the static mold half 32 also shows the moving mold half 34 and the cavity 36.

There are, however, a number of differences compared to the embodiment example of FIG. 3. These relate to the environment of the sprue region 42 and the nozzle heater 44. The latter is embedded in a circumferential groove in the body of the diecasting nozzle 40.

At the sprue region 42, a part of the static mold half 32 is depicted, which is formed such that an insulating air space 58 forms between said fixed mold half and the diecasting nozzle 40. Also arranged in this region is a temperature sensor 62, which is connected via a lead 63. In the detail view, the channel for said lead may also be used for a supply line of the heater.

Figure 6:
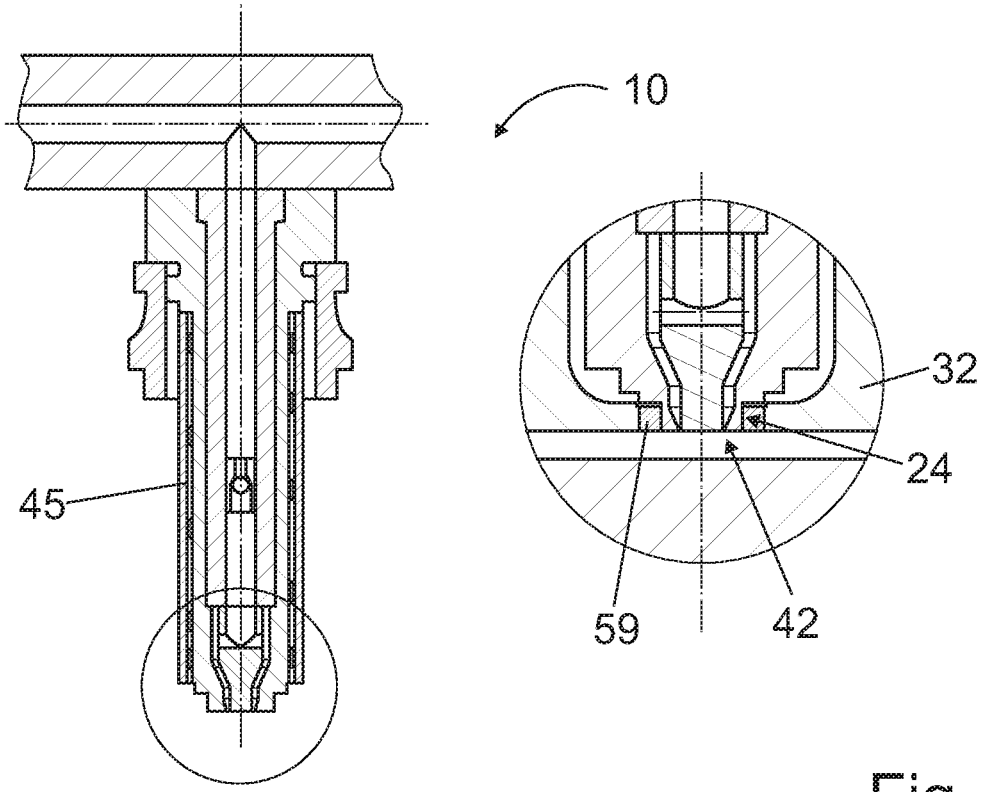
FIG. 6 shows a further embodiment of the diecasting nozzle system according to the invention.

FIG. 6 shows a schematic cross-sectional illustration, including a detail view, of an embodiment of the diecasting nozzle system 10 according to the invention, which differs from those shown in FIGS. 3 and 5 with respect to the type of heating and the design of the sprue region 42. To improve the thermal insulation from the static mold half 32, the sprue region 42 is provided with an insulating ferrule 59, which is for example made of a titanium alloy. Said insulation ferrule is arranged at the sprue region 42 and surrounds the latter in the region of the radial seat 24.

In the illustrated embodiment example, the diecasting nozzle 40 is heated via a printed nozzle heater 45, which is applied to the body of the diecasting nozzle 40 in a helical configuration and is protected by a moving protective sleeve.

Figure 7:
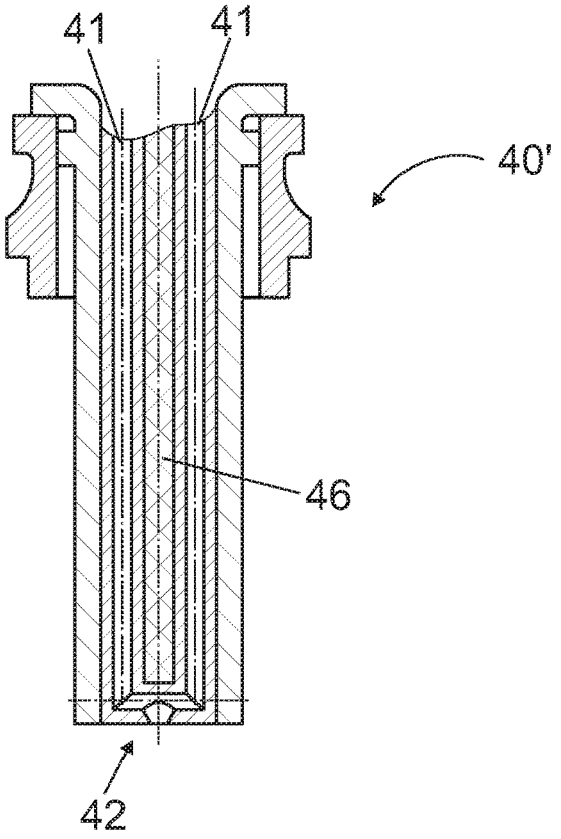
FIG. 7 shows a further embodiment of the diecasting nozzle according to the invention and FIG. 8 shows a number of different sprue geometries.

FIG. 7 is a schematic cross-sectional illustration of a further embodiment of a diecasting nozzle 40' according to the invention, which substantially differs from the embodiments described above. It includes a nozzle heater 46 configured as an internal heating rod. The nozzle heater 46 is surrounded by the nozzle channel 41, which thereby has the shape of a hollow cylinder. Through this, the heat can easily be guided directly to the sprue region 42 without requiring any particular thermal insulation measures to counteract the heat dissipation. This embodiment is particularly advantageous for the use of melts with a melting temperature of more than 600° C. or for multi gating, in which melt is supplied from one diecasting nozzle to multiple cavities located closely adjacent to one another.

The hollow-cylindrical nozzle channel 41 has no nonreturn valve since the latter needs to be arranged in the melt runner of the melt distributor when employing such a diecasting nozzle 40'.

The nozzle channel 41 connects to the sprue region 42, which in the present embodiment example has a dot-shaped configuration.

Further sprue shapes are illustrated in FIG. 8.

View a) shows a sprue geometry of a multi-path nozzle, which can be used to fill a multi-cavity mold. In this case, the melt is then injected not only into one cavity but into multiple cavities arranged closely adjacent to one another, so that multiple parts can be fabricated with one nozzle.

View b) shows a sprue geometry that results from a cross-section of FIGS. 2 to 6 and is formed as an annular sprue with a large cross-section for short casting times. The tip arranged inside the ring, i.e. the central duct 61 (cf. FIGS. 3 and 4) provides for heat transfer from the heated nozzle body into the sprue region and to this end is made of a material having a particularly high heat conductivity, for example a suitable alloy. Through this, any melt that may have solidified in the sprue region upon separation of the product and thus elimination of the heat sink is quickly remelted, so that a new diecasting cycle for fabrication of a further product can be started. This can be additionally supported especially if the entire sprue region is made of said material having a particularly high heat conductivity.

In view c) the annular sprue is supplemented by a dot-shaped sprue arranged centrally inside the ring, so that an even larger volumetric flow rate can be achieved for the melt. A dot-shaped sprue without the additional annular sprue may also be provided. Such a variant already results from the diecasting nozzle 40 illustrated in FIG. 7.

Views d) to f) respectively show a sprue geometry that provides similar stability in the sprue region but offers a quicker injection of the melt into the cavity, particularly if the latter has a larger volume. This is achieved by grooves originating laterally from the annular sprue geometry so as to form a line, two crossed lines, or a star-shaped sprue geometry.

LIST OF REFERENCE NUMERALS

1 hot-chamber system
2 hot-chamber diecasting machine
3 casting vessel
4 melt
5 piston
6 piston drive
7 machine nozzle
10 diecasting nozzle system
12 machine nozzle boss
20 melt distributor
22 melt channel
24 radial seat
26 axial seat
30 casting mold
32 static mold half
34 moving mold half
36 cavity
36' product
40, 40' diecasting nozzle
41 nozzle channel
42 sprue region
43 nozzle heater (sleeve)

44 nozzle heater (circumferential groove)
45 nozzle heater (moving sleeve)
46 nozzle heater (internal heater)
48 nonreturn valve
50 sprue insulator
58 insulating space
59 insulating ferrule
60 separation edge
61 central duct
62 temperature sensor
63 lead

The invention claimed is:

1. A diecasting nozzle system (10) for use in a hot-chamber system (1) for the diecasting of metal melt (4), comprising a hot-chamber diecasting machine (2) with a casting vessel (3) and a melt distributor (20), which distributes the metal melt (4) uniformly from a machine nozzle (7) among heated diecasting nozzles (40), wherein at least one nonreturn valve (48) is arranged between a sprue region (42) of the diecasting nozzles (40) and the casting vessel (3), wherein said at least one nonreturn valve (48) prevents the metal melt (4) from flowing back from the sprue region (42) in the direction of the casting vessel (3), such that said at least one nonreturn valve prevents retraction of the liquid metal melt from an upper diecasting nozzle and at the same time the flow of the liquid metal melt out of a lower diecasting nozzle due to gravity, characterized in that the at least one nonreturn valve (48) is respectively arranged between the sprue region (42) of at least one upper diecasting nozzle (40) and a final branch of melt runners (22) in the melt distributor (20) to each of the respective diecasting nozzles (40).

2. The diecasting nozzle system according to claim 1, wherein the diecasting nozzles (40) can be heated from inside and/or from outside in the region of a body of the diecasting nozzles (40) and comprises a sprue region (42) made of a material with a heat conductivity corresponding at least to the heat conductivity of the melt and/or can be heated separately.

3. The diecasting nozzle system according to claim 1, wherein a thermal protective device, which reduces heat dissipation from the sprue region (42) in the direction of a casting mold (30), is provided in the sprue region (42) of each diecasting nozzle (40).

4. The diecasting nozzle system according to claim 3, wherein the thermal protective device is configured as a thermal insulator (58, 59) in the sprue region (42) or as a counter-heater arranged in the sprue region.

5. The diecasting nozzle system according to claim 4, wherein the thermal insulator is configured as an insulating ferrule (58) made of a material surrounding the sprue region (42) and having a low heat conductivity, as a sprue insulator (50) configured as an insulating air, gas or vacuum layer inside the sprue region (42), and/or as an insulating space (58) between bodies of the diecasting nozzles (40) and the casting mold (30).

6. The diecasting nozzle system according to claim 4, wherein the counter-heater is configured as a segment that is arranged around the sprue region (42) and can be temperature-controlled separately, and/or as a separately heated sprue region (42).

7. The diecasting nozzle system according to claim 6, wherein a device that uses a $CO_2$ cycle is provided for operation of the counter-heater.

8. The diecasting nozzle system according to claim 1, wherein a nozzle channel (41) includes a separation edge (60) at an outer circumference of a central duct (61) and/or at an inner circumference of the nozzle channel (41) in the sprue region (42) of the diecasting nozzles (40), wherein said separation edge (60) is designed such that it forms a breaking point in the melt (4) solidified in the sprue region (42) where a product (36') separates when the sprue region (42) is lifted off a casting mold (30).

9. The diecasting nozzle system according to claim 1, wherein a temperature sensor (62) is arranged in the sprue region (42).

10. The diecasting nozzle system according to claim 1, wherein the nonreturn valve (48) is arranged in a nozzle channel (41) of the diecasting nozzles (40).

11. The diecasting nozzle system according to claim 1, wherein the nonreturn valve (48) is configured as a freely moving ball cooperating with a valve seat.

12. A diecasting method, which uses a diecasting nozzle system according to claim 1, characterized by the following method steps:

fitting the permanently and uniformly heated diecasting nozzle (40) onto the casting mold (30);

opening the nonreturn valve (48) during injection of the melt (4) through the melt runner (41) and the sprue region (42) into the casting mold (30);

solidifying the melt (4) to obtain a product (36') inside the casting mold (30) including the sprue region (42), wherein heat flows from the sprue region (42) into the product;

lifting off the diecasting nozzle (40), separating the product (36'), and non-occurrence of heat dissipation from the sprue region (42);

melting the solidified melt in the sprue region (42) of each of the diecasting nozzles (40) through continued heat flow from the diecasting nozzle (40), wherein melt (4) flowing from the upper diecasting nozzles (40) via the melt distributor (20) is prevented from flowing out of the lower diecasting nozzles (40) in the melt distributor (20) by closing the nonreturn valves (48) in the region of the upper diecasting nozzles (40).

* * * * *